US006009841A

United States Patent [19]

Hickey

[11] Patent Number: 6,009,841

[45] Date of Patent: Jan. 4, 2000

[54] INTERNAL COMBUSTION ENGINE HAVING HYBRID CYLINDER VALVE ACTUATION SYSTEM

[75] Inventor: John Curtis Hickey, Belleville, Mich.

[73] Assignee: Ford Global Technologies, Inc., Dearborn, Mich.

[21] Appl. No.: 09/131,796

[22] Filed: Aug. 10, 1998

[51] Int. Cl.[7] ..... F01L 1/04; F01L 9/04

[52] U.S. Cl. ..... 123/90.15; 123/90.11; 123/90.12

[58] Field of Search ..... 123/90.1, 90.11, 123/90.12, 90.14, 90.15, 90.16, 90.17, 90.27, 308, 315, 432

[56] References Cited

U.S. PATENT DOCUMENTS

| | | | |
|---|---|---|---|
| 4,455,543 | 6/1984 | Pischinger et al. . | |
| 4,515,343 | 5/1985 | Pischinger et al. . | |
| 4,682,574 | 7/1987 | Kreuter . | |
| 4,715,330 | 12/1987 | Bychl . | |
| 4,715,332 | 12/1987 | Kreuter . | |
| 4,719,882 | 1/1988 | Kreuter . | |
| 4,777,915 | 10/1988 | Bonvallet . | |
| 4,831,973 | 5/1989 | Richeson, Jr. . | |
| 5,070,826 | 12/1991 | Kawamura . | |
| 5,074,259 | 12/1991 | Pusic . | |
| 5,095,856 | 3/1992 | Kawamura . | |
| 5,115,772 | 5/1992 | Kawamura . | |
| 5,131,624 | 7/1992 | Kreuter et al. . | |
| 5,222,714 | 6/1993 | Morinigo et al. . | |
| 5,331,931 | 7/1994 | Blish et al. | 123/90.11 |
| 5,544,626 | 8/1996 | Diggs et al. . | |
| 5,598,814 | 2/1997 | Schroeder et al. | 123/90.11 |
| 5,653,198 | 8/1997 | Diggs . | |
| 5,657,726 | 8/1997 | Diggs . | |
| 5,669,341 | 9/1997 | Ushirono et al. | 123/90.11 |
| 5,692,463 | 12/1997 | Liang et al. . | |

*Primary Examiner*—Weilun Lo
*Attorney, Agent, or Firm*—Jerome R. Drouillard

[57] ABSTRACT

An internal combustion engine includes a piston reciprocably housed within a cylinder and hybrid intake valves, with one intake valve being driven by a camshaft and at least one intake valve being selectively powered by a power source other than the camshaft, such as a solenoid.

12 Claims, 2 Drawing Sheets

INTERNAL COMBUSTION ENGINE HAVING HYBRID CYLINDER VALVE ACTUATION SYSTEM

BACKGROUND OF THE INVENTION

1. Field of the Invention

The present invention relates to an engine in which various cylinder valves are operated by more than one type of actuation device.

2. Disclosure Information

Engine designers seeking to increase automotive powerplant fuel economy and performance, while decreasing engine emissions, have explored the concept of variable valve timing for a considerable period of time. Although attempted from time to time, electronically driven valves, such as solenoid operated valves, have not generally been successful because the amount of power required to open a valve to an extent necessary to allow air charge to enter an engine's cylinder during operation at maximum power was considerable and impaired fuel efficiency of the engine. This is particularly true where electronic has been applied to an exhaust valves, which must open when the cylinder is under positive pressure. The present invention allows the use of a randomly operable, electronically powered intake valve in combination with a selectively operable camshaft-powered intake valve and a conventionally powered camshaft driven exhaust valve. This inventive valve arrangement, while allowing the flexibility of electronically controlled valves, permits such flexibility along with greatly reduced power consumption.

SUMMARY OF THE INVENTION

An internal combustion engine includes a piston reciprocably housed within the cylinder, a first intake valve for admitting fresh charge into the cylinder, with the first intake valve being selectively powered by a camshaft, and a second intake valve which is selectively powered by a power source other than a camshaft. At least one exhaust valve allows products of combustion to be evacuated from the engine cylinder. The exhaust valve is powered by a camshaft.

The first intake valve, which, as noted above, is powered by a camshaft, is selectively engageable via a specially prepared camshaft follower, which is operatively connected with an engine controller. The second intake valve may be driven by an electrically powered actuator such as a solenoid. Alternatively, the second intake valve may be driven by an electrohydraulic actuator.

According to another aspect of the present invention, a method for operating an engine with a hybrid cylinder valve system includes the steps of determining engine load, admitting fresh charge into the cylinder by means of a randomly operable intake poppet valve having a relatively small opening area so as to promote charge motion in the event that the engine load is in a lower range, and admitting fresh charge into the cylinder by means of a camshaft operated intake valve in the event that the engine load is in a medium range. Finally, the method includes admitting fresh into the cylinder by means of both the randomly operable intake valve and the camshaft operated valve in the event that the engine load is in a high range. As used herein, light load refers to loads in the vicinity of 1 bar mean effective pressure (MEP). Medium load refers to loads in the vicinity of 2.5 bar MEP. Finally, heavy load refers to MEP in the range of 7–10 bar.

It is an advantage of the present invention that an engine equipped with the present hybrid valve system will have performance, including emissions and power output, approaching that offered by a fully random, electrically operable poppet valve system but without the attendant valve system power loss and resulting fuel economy penalty.

It is a further advantage of the present invention that an electrically operable, randomly operable poppet valve may be used to create high charge motion within the cylinder, thereby increasing the engine's tolerance to exhaust gas recirculation, and thereby decreasing the output of oxides of nitrogen (NOx) from the engine.

Other advantages, as well as objects and features of the present invention, will become apparent to the reader of this specification.

DETAILED DESCRIPTION OF PREFERRED EMBODIMENTS

Figure 1:
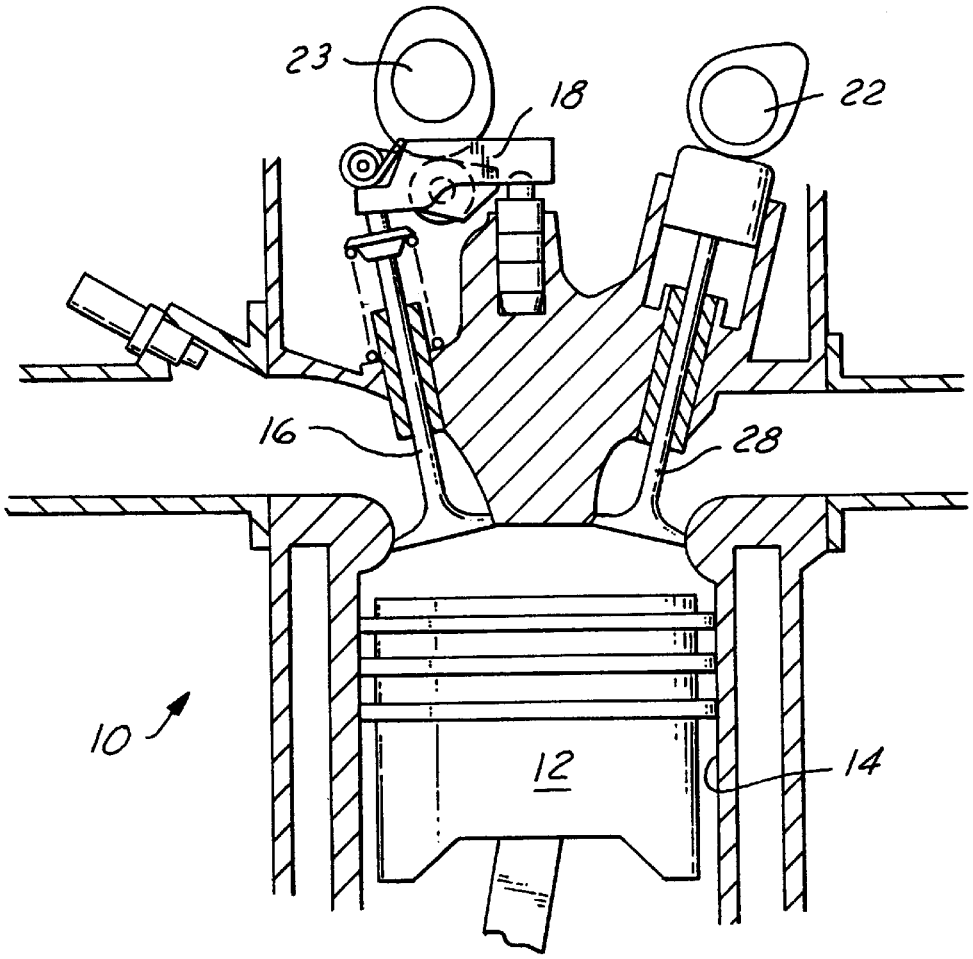
FIGS. 1 and 1A are schematic representations of an engine having a hybrid cylinder valve system according to the present invention.
Figure 1A:
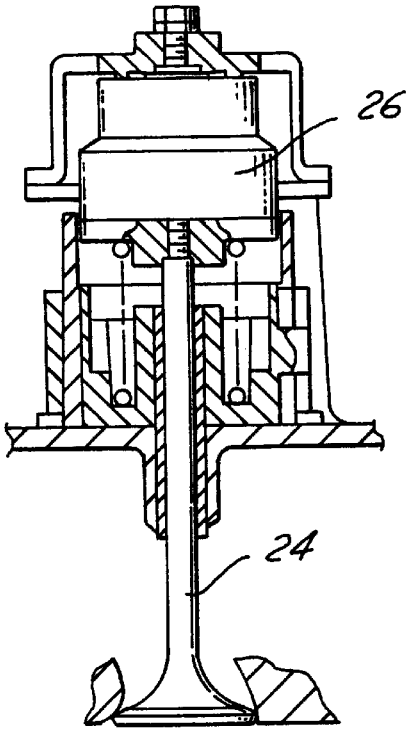
Figure 2:
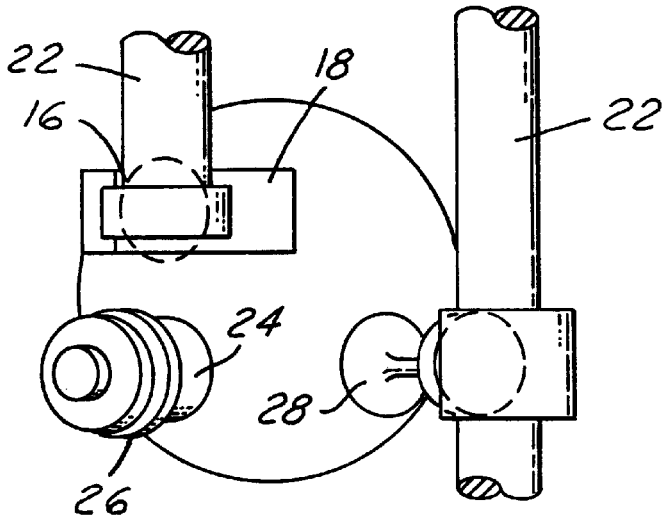
FIG. 2 is a plan view of an engine cylinder head equipped according to the present invention.

As shown in FIG. 1, engine 10 has piston 12 housed reciprocably within cylinder 14. As seen in FIGS. 1, 1A and 2, cylinder 14 is serviced by camshaft powered intake valve 16, randomly operable intake valve 24, and exhaust valve 28. Beginning with the latter valve, i.e., exhaust valve 28, it is seen from the Figures that camshaft 22 powers exhaust valve 28 without the capacity to disable valve 28. In other words, exhaust valve 28 operates whenever engine 10 is being operated. This situation may be contrasted with that pertaining to valves 16 and 24. Camshaft powered intake valve 16 is selectively powered by camshaft 23 by means of follower 18. U.S. Pat. Nos. 5,544,626 and 5,653,198, which are assigned to the assignee of the present invention, and which are hereby incorporated with reference into this specification, disclose mechanisms for selectively powering a valve. This selective capability allows controller 36 (FIG. 3) to operate camshaft powered intake valve 16 when more air charge is needed at medium and high engine loads, as will be explained more fully below.

Randomly operable intake valve 24 (FIG. 1A) is powered by solenoid 26. U.S. Pat. No. 4,777,915, which is also incorporated by reference into this specification, discloses one of many schemes for driving a poppet valve by means of an electrical solenoid. Those skilled in the art will appreciate in view of this disclosure that many different combinations of solenoid and electrohydraulic and hydraulic devices could be used for the purpose of selectively powering a cylinder valve by a power source other than a camshaft so that the valve is randomly operable.

An advantage of random intake valve operation resides in the fact that eliminating overlap between operation of the intake and exhaust valves during idle and low load operation will promote combustion stability and cause decreased engine emissions of hydrocarbons, which rise when the engine misfires due to valve overlap and the attendant induction of exhaust gas into the cylinder.

Figure 3:
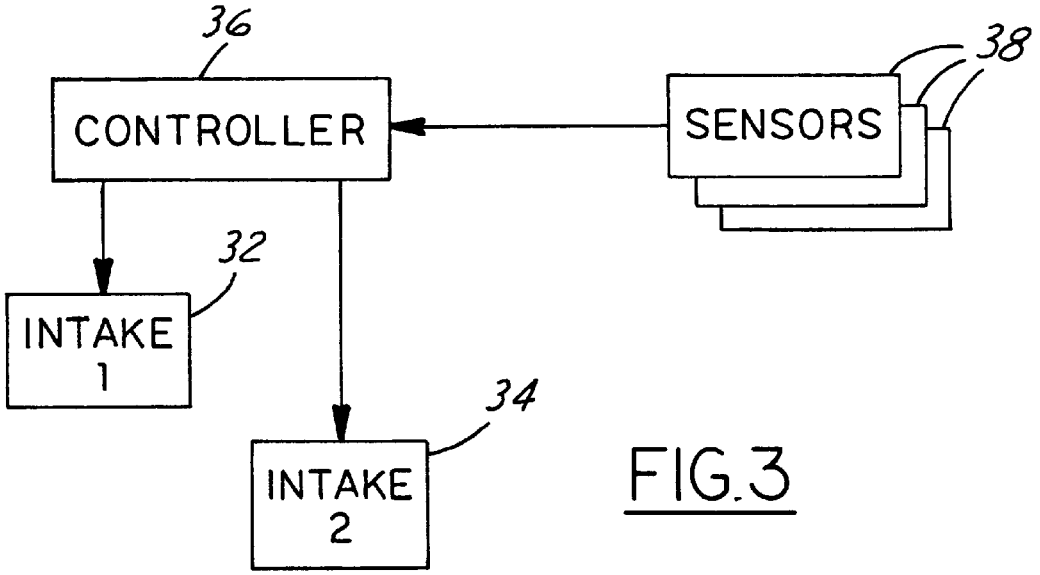
FIG. 3 is a block diagram of a control system for operating an engine according to the present invention.

As shown in FIG. 3, controller 36 operates intake 1 and intake 2. Intake 1, which is labeled 32 in FIG. 3, corresponds to intake valve 16 and its associated operating equipment. Intake 2 corresponds to intake valve 24 and its associated operating hardware. A plurality of sensors 38 provides information to controller 36 regarding engine load and such other parameters as are desired, such as throttle position, engine coolant temperature, charge temperature, spark timing, and other parameters known to those skilled in the art and suggested by this disclosure. In any event, it is generally the case that at lower engine loads, only randomly operable intake valve 24 will be operated by controller 36, and valve 24 will be opened by controller 36 to a much smaller lift than valve 16. This is true even though valves 24 and 16 have heads which are approximately the same diameter. Operating randomly operable intake valve 24 with a low lift allows increased charge motion within cylinder 14 because the charge entering cylinder 14, when passing through the small opening area provided by valve 24, will be accelerated and this in turn will cause increased kinetic energy to the charge. This is beneficial because it improves the combustion stability of the engine. The fact that valve 24 opens only to a small extent is further beneficial because it reduces the amount of electrical power required to operate valve 24.

As engine load increases and engine 10 is no longer able to induct enough fresh charge past valve 24, valve 16 will be activated when controller 36 provides a signal to selective follower 18. At such time, valve 16 will begin to reciprocate in the manner of a conventional valve. If desired, valve 24 may be shut off at the time valve 16 is engaged so as to avoid a torque spike which would otherwise occur due to a greatly increased airflow through both valves. Thus, valve 24 will be disabled when engine 10 reaches an operating regime wherein the maximum airflow through valve 24 approximates the airflow through valve 16. Thereafter, if engine load is increased further, valve 24 will be once again opened, but for increasingly time periods so as to allow more air charge to enter the engine. Because valve 24 may be opened randomly, it is possible hold valve 24 open for lengths of time which are generally greater than what would be possible if valve 24 were driven by camshaft 23.

While the invention has been shown and described in its preferred embodiments, it will be clear to those skilled in the arts to which it pertains that many changes and modifications may be made thereto without departing from the scope of the invention. For example, more than one exhaust valve may be employed, and there may be more than one intake powered by means other than a camshaft as well as more than one camshaft powered intake valve.

What is claimed is:

1. An internal combustion engine, comprising:

a piston reciprocably housed within a cylinder;

a first intake valve for admitting fresh charge into the cylinder, with said first intake valve being selectively powered by a camshaft;

a second intake valve for admitting fresh charge into the cylinder, with said second intake valve being selectively powered by a power source other than a camshaft; and at least one exhaust valve for allowing products of combustion to be evacuated from the cylinder, with said at least one exhaust valve being powered by a camshaft.

2. An engine according to claim 1, wherein said first intake valve is driven by a selectively engageable follower driven by a camshaft.

3. An engine according to claim 1, wherein said second intake valve is driven by an electrically powered actuator.

4. An engine according to claim 3, wherein said electrically powered actuator comprises a solenoid.

5. An engine according to claim 1, wherein said second intake valve is driven by an electrohydraulic actuator.

6. An engine according to claim 1, wherein said second intake valve and said first intake valves are poppet valves having heads with the same diameter, with the second intake valve having a much smaller lift than the first intake valve.

7. An engine according to claim 1, wherein said first intake valve and said exhaust valve are powered by separate camshafts.

8. An engine according to claim 1, wherein fresh charge is admitted by only the second intake valve at low engine loads, by only the first intake valve at medium engine loads, and by both the first and second intake valves at high engine loads.

9. An internal combustion engine having a hybrid cylinder valve system, said engine comprising:

a piston reciprocably housed within a cylinder;

a first intake poppet valve for admitting fresh charge into the cylinder during operation at medium and higher loads, with said first intake valve being selectively powered by a camshaft;

a second intake poppet valve for admitting fresh charge into the cylinder during operation at lower loads, with said second intake valve being selectively powered by a power source other than a camshaft; and at least one exhaust valve for allowing products of combustion to be evacuated from the cylinder, with said at least one exhaust valve being powered by a camshaft.

10. An engine according to claim 9, wherein said second intake valve is operated in combination with said first intake valve at higher loads.

11. An engine according to claim 9, wherein the heads of said first and second intake valves are of generally equivalent area, with the opening area of said second intake valve being less than the opening area of said first intake valve.

12. An engine according to claim 9, wherein said second intake valve may be operated independently of said first intake valve and said at least one exhaust valve.

* * * * *